US008943776B2

(12) United States Patent
Strickland et al.

(10) Patent No.: US 8,943,776 B2
(45) Date of Patent: Feb. 3, 2015

(54) COMPOSITE STEEL JOIST

(71) Applicant: Ispan Systems LP, Princeton (CA)

(72) Inventors: Michael R. Strickland, Richmond Hill (CA); Douglas M. Fox, Kitchener (CA); Richard Wilson Strickland, Brantford (CA)

(73) Assignee: Ispan Systems LP, Princeton, Ontario (CA)

( * ) Notice: Subject to any disclaimer, the term of this patent is extended or adjusted under 35 U.S.C. 154(b) by 0 days.

(21) Appl. No.: 13/838,779

(22) Filed: Mar. 15, 2013

(65) Prior Publication Data

US 2014/0090332 A1 Apr. 3, 2014

Related U.S. Application Data

(60) Provisional application No. 61/707,331, filed on Sep. 28, 2012.

(51) Int. Cl.

| | |
|---|---|
| ***E04H 12/00*** | (2006.01) |
| ***E04C 3/293*** | (2006.01) |
| ***E04B 5/29*** | (2006.01) |
| ***E04B 5/40*** | (2006.01) |
| ***E04C 3/294*** | (2006.01) |

(52) U.S. Cl.

CPC . *E04C 3/293* (2013.01); *E04B 5/29* (2013.01); *E04B 5/40* (2013.01); *E04C 3/294* (2013.01)

USPC ..... 52/650.2; 52/250; 52/272; 52/289; 52/334; 52/414; 52/677

(58) Field of Classification Search

USPC ..... 52/250, 272, 289, 333, 334, 414, 650.1, 52/650.2, 677, 698, 702, 712, 634, 638

See application file for complete search history.

(56) References Cited

U.S. PATENT DOCUMENTS

| | | | |
|---|---|---|---|
| 827,268 | A | 7/1906 | Stieper |
| 1,360,720 | A | 11/1920 | Brown et al. |

(Continued)

FOREIGN PATENT DOCUMENTS

| | | |
|---|---|---|
| AU | 47479/79 | 12/1980 |
| AU | 540590 | 1/1985 |

(Continued)

OTHER PUBLICATIONS

International Search Report for PCT/CA2010/001750, mailed Feb. 21, 2011.

(Continued)

*Primary Examiner* — Brian Glessner
*Assistant Examiner* — Brian D Mattei
(74) *Attorney, Agent, or Firm* — Hill & Schumacher

(57) ABSTRACT

The present disclosure relates to a steel joist assembly for use in association with a concrete slab and being adapted to form a composite steel joist including a steel joist and a pair of end connectors. The steel joist has a top portion with a generally planar top surface and a planar web generally orthogonal to the generally planar top surface. An end connector is attached at each end of the steel joist. Each end connector has a strut and a diagonal member. The strut has a generally planar bottom surface which is attached to a portion of the generally planar top surface of the steel joist and the diagonal member is attached at one end thereof to the strut and at the other end thereof to a portion of the planar web of the steel joist.

22 Claims, 9 Drawing Sheets

(56) References Cited

U.S. PATENT DOCUMENTS 1,622,559 A 3/1927 Zabriskie
1,915,424 A 6/1933 Kerr
1,918,345 A 7/1933 McHose
1,974,730 A 9/1934 Zollinger
1,983,632 A 12/1934 Miller
2,088,781 A 8/1937 Folsom
2,108,373 A 2/1938 Greulich
2,169,253 A 8/1939 Kotrbaty
2,194,810 A 3/1940 Reiner
2,246,215 A 6/1941 Nagin et al.
2,256,812 A 9/1941 Miller
2,457,250 A 12/1948 Macomber
2,514,607 A 7/1950 McLean
2,624,430 A 1/1953 Macomber
2,630,890 A 3/1953 Macomber
2,662,272 A 12/1953 Macomber
2,860,743 A 11/1958 Cliff
2,864,471 A 12/1958 Williams
3,158,731 A 11/1964 Cape
3,221,467 A 12/1965 Henkels
3,288,977 A 11/1966 Keller
3,349,535 A 10/1967 Balinski
3,367,080 A 2/1968 McClelland
3,381,439 A 5/1968 Thulin, Jr.
3,392,499 A * 7/1968 McManus ..... 52/702
3,483,665 A 12/1969 Miller
3,487,861 A 1/1970 Fahrenbach
3,527,007 A 9/1970 McManus
3,600,868 A 8/1971 Wilson, Jr.
3,626,567 A 12/1971 Michelson et al.
3,639,962 A 2/1972 Gooder
3,641,303 A 2/1972 Collins
3,736,719 A * 6/1973 Wise ..... 52/677
3,818,083 A 6/1974 Butts et al.
3,942,297 A 3/1976 Kitagawa
3,945,168 A 3/1976 Butts et al.
3,945,741 A 3/1976 Wendt
3,979,868 A 9/1976 Butts et al.
4,041,664 A 8/1977 Davis, Jr.
4,056,908 A 11/1977 McManus
4,122,647 A 10/1978 Kovar
4,151,694 A 5/1979 Sriberg et al.
4,159,604 A 7/1979 Burrell
4,189,883 A 2/1980 McManus
4,207,719 A 6/1980 Knowles
4,281,497 A 8/1981 Luotonen et al.
4,385,476 A 5/1983 Slager
4,409,771 A 10/1983 Lowe
4,421,969 A 12/1983 Tanenbaum
4,432,178 A 2/1984 Taft
4,441,292 A 4/1984 Ericsson
4,454,695 A 6/1984 Person
4,476,662 A 10/1984 Fisher
4,490,958 A 1/1985 Lowe
4,548,014 A 10/1985 Knowles
4,549,381 A 10/1985 Holtz
4,560,301 A 12/1985 Gilb
4,566,240 A 1/1986 Schilger
4,569,177 A 2/1986 Ottinger
4,592,184 A 6/1986 Person et al.
4,653,237 A * 3/1987 Taft ..... 52/335
4,688,358 A 8/1987 Madray
4,691,494 A 9/1987 Gwynne
4,702,059 A 10/1987 Holtz
4,715,155 A 12/1987 Holtz
4,720,957 A 1/1988 Madray
4,729,201 A 3/1988 Laurus et al.
4,741,138 A 5/1988 Rongoe, Jr.
4,793,113 A 12/1988 Bodnar
4,836,436 A 6/1989 Hannah
4,837,994 A 6/1989 Stohs
4,845,908 A 7/1989 Stohs
4,887,406 A 12/1989 Saia
4,937,997 A 7/1990 Thomas, Jr. et al.
4,937,998 A 7/1990 Goldberg
4,947,612 A 8/1990 Taylor et al.
4,982,545 A 1/1991 Stromback
4,986,051 A 1/1991 Meyer et al.
5,004,369 A 4/1991 Young
5,146,726 A 9/1992 Ellison, Jr.
5,207,045 A 5/1993 Bodnar
5,214,900 A 6/1993 Folkerts
5,220,761 A 6/1993 Selby
5,230,190 A 7/1993 Schuette
5,240,342 A 8/1993 Kress, Jr.
5,301,486 A 4/1994 Taylor
5,373,675 A 12/1994 Ellison, Jr.
5,417,028 A 5/1995 Meyer
5,476,704 A 12/1995 Kohler
5,499,480 A 3/1996 Bass
5,509,243 A * 4/1996 Bettigole et al. ..... 52/334
5,527,625 A 6/1996 Bodnar
5,544,464 A 8/1996 Dutil
5,546,716 A 8/1996 Broxterman et al.
5,553,437 A 9/1996 Navon
5,625,995 A 5/1997 Martin
5,669,197 A 9/1997 Bodnar
5,687,538 A 11/1997 Frobosilo et al.
5,761,873 A 6/1998 Slater
5,771,653 A 6/1998 Dolati et al.
5,809,722 A * 9/1998 Bertsche ..... 52/334
5,842,318 A 12/1998 Bass et al.
5,865,008 A 2/1999 Larson
5,875,605 A 3/1999 Rudd
5,895,534 A 4/1999 Daley et al.
5,927,036 A 7/1999 Matthews et al.
5,937,608 A 8/1999 Kucirka
5,941,035 A 8/1999 Purse
6,073,414 A 6/2000 Garris et al.
6,131,362 A 10/2000 Buecker
6,170,217 B1 1/2001 Meyer
6,240,682 B1 6/2001 James et al.
6,254,306 B1 7/2001 Williams
6,263,634 B1 7/2001 Bodnar et al.
6,301,854 B1 10/2001 Daudet et al.
6,301,857 B1 10/2001 Vrana
6,357,191 B1 3/2002 Ault et al.
6,415,577 B1 7/2002 Curtis
6,418,694 B1 7/2002 Daudet et al.
6,436,552 B1 8/2002 Walker et al.
6,457,292 B1 10/2002 Vrana
6,484,464 B1 11/2002 Ochoa
6,519,908 B1 2/2003 Masterson et al.
6,571,527 B1 6/2003 Rattini
6,612,087 B2 9/2003 diGirolamo et al.
6,634,153 B1 10/2003 Peterson
6,658,809 B2 12/2003 Collins
6,662,517 B1 12/2003 Thompson
6,708,459 B2 3/2004 Bodnar
6,761,005 B1 7/2004 Daudet et al.
6,799,406 B2 10/2004 Gosselin et al.
6,799,407 B2 10/2004 Saldana
6,843,036 B2 1/2005 Stewart, III
6,874,294 B2 4/2005 Masterson et al.
6,964,140 B2 11/2005 Walker et al.
7,086,208 B2 8/2006 Masterson et al.
7,093,401 B2 8/2006 Collins
7,104,024 B1 9/2006 diGirolamo et al.
7,107,730 B2 9/2006 Park
7,197,854 B2 * 4/2007 Bettigole et al. ..... 52/414
7,231,746 B2 6/2007 Bodnar
7,240,463 B2 7/2007 Masterson et al.
7,409,804 B2 8/2008 Moody et al.
7,546,714 B2 6/2009 Masterson et al.
7,587,877 B2 * 9/2009 Strickland et al. ..... 52/837
7,624,550 B2 12/2009 Ospina
2002/0020138 A1 2/2002 Walker et al.
2002/0029538 A1 3/2002 Webb
2002/0046534 A1 4/2002 Heinly
2002/0069606 A1 6/2002 Gosselin et al.
2002/0144484 A1 10/2002 Vrana
2003/0014934 A1 1/2003 Bodnar
2003/0014935 A1 1/2003 Bodnar
2003/0061780 A1 4/2003 Masterson

(56) References Cited

U.S. PATENT DOCUMENTS

| | | | | |
|---|---|---|---|---|
| 2003/0084637 | A1 | 5/2003 | Daudet | |
| 2005/0102962 | A1 | 5/2005 | McInerney et al. | |
| 2005/0115195 | A1* | 6/2005 | Bettigole et al. | 52/782.1 |
| 2005/0144892 | A1 | 7/2005 | Strickland et al. | |
| 2006/0010809 | A1 | 1/2006 | Lafreniere | |
| 2009/0193750 | A1 | 8/2009 | Klima | |
| 2009/0320395 | A1* | 12/2009 | Strickland et al. | 52/289 |
| 2010/0139201 | A1* | 6/2010 | Strickland et al. | 52/634 |
| 2010/0275544 | A1* | 11/2010 | Studebaker et al. | 52/582.1 |
| 2011/0047915 | A1* | 3/2011 | Waters et al. | 52/414 |
| 2011/0120051 | A1* | 5/2011 | Strickland et al. | 52/838 |
| 2011/0162319 | A1* | 7/2011 | Strickland et al. | 52/831 |
| 2011/0219720 | A1 | 9/2011 | Strickland et al. | |
| 2012/0233956 | A1* | 9/2012 | Fey | 52/677 |

FOREIGN PATENT DOCUMENTS

| | | | | |
|---|---|---|---|---|
| AU | 543398 | | 1/1985 | |
| AU | 14733/97 | | 2/1997 | |
| AU | 199952660 | | 10/1999 | |
| AU | 762835 | | 7/2003 | |
| AU | 2004100666 | | 8/2004 | |
| CA | 900687 | | 5/1972 | |
| CA | 1172463 | | 8/1984 | |
| CA | 2092809 | | 11/2001 | |
| CA | 2412726 | | 11/2009 | |
| CA | 2455071 | | 11/2011 | |
| GB | 668485 | | 3/1952 | |
| GB | 1447055 | | 8/1976 | |
| GB | 2340141 | | 2/2000 | |
| GB | 2340146 | A * | 2/2000 | E04C 2/08 |
| JP | 8338103 | | 12/1996 | |
| WO | 0046459 | | 8/2000 | |
| WO | 02/01016 | | 1/2002 | |
| WO | 03/057931 | | 7/2003 | |
| WO | 2004038123 | | 5/2004 | |
| WO | 2005/042869 | | 5/2005 | |

OTHER PUBLICATIONS

Ortech Industries Pty Ltd., Easibeams Steel Sections [pamphlet] (no date).

International Search Report for PCT/CA2010/001405, mailed Jan. 27, 2011.

International Search Report, PCT/CA2013/050738, filed Sep. 27, 2013, issued Jan. 24, 2014, 5 pages.

* cited by examiner

COMPOSITE STEEL JOIST

FIELD OF THE DISCLOSURE

This disclosure relates to cold rolled steel joists and in particular unitary steel joist that are for use with a concrete slab.

BACKGROUND

Cold rolled steel joists are becoming more popular. Heretofore, where cold rolled steel joist is a unitary steel joist they were designed to be used as bottom chord bearing joists. In general a unitary steel joist is not designed to be used as a top chord bearing type joist. Accordingly it would be advantage to provide a unitary steel joist assembly that can be used in a composite steel joist/concrete assembly, with increased end reaction load capacity capabilities.

SUMMARY

The present disclosure relates to a steel joist assembly for use in association with a concrete slab and being adapted to form a composite steel joist including a steel joist and a pair of end connectors. The steel joist has a top portion with a generally planar top surface and a planar web generally orthogonal to the generally planar top surface. An end connector is attached at each end of the steel joist. Each end connector has a strut and a diagonal member. The strut has a generally planar bottom surface which is attached to a portion of the generally planar top surface of the steel joist and the diagonal member is attached at one end thereof to the strut and at the other end thereof to a portion of the planar web of the steel joist.

The end connector may further include a shoe attached to the distal end of the strut. The strut may be a pair of generally L-shaped members arranged back to back and each having an upper lip extending outwardly. The diagonal member may be a generally L-shaped member. The pair of generally L-shaped members may each have a plurality of holes formed therein adapted to receive reinforcing bars.

The steel joist assembly may further include a steel deck attached to the generally planar top surface of the steel joist. The deck may be attached with a plurality of screws and the screws have a multi-shear connectors attached thereto which extend upwardly. The multi-shear connectors may have a bottom portion, a back portion, a sloped portion and two side portions wherein the bottom portion rests on the deck, the back portion extends upwardly from the bottom portion, the side portions extend inwardly from the back portion and the sloped portion is sloped inwardly from the back portion whereby the side portions and sloped portions are shaped to receive a reinforcing bar.

The steel joist may be a unitary steel joist. The steel joist may have a generally vertical planar web; a generally horizontal bottom flange extending outwardly on each side of the planar web, the bottom flange having a double thickness; a generally horizontal top flange extending outwardly on each side of the planar web, the top flange having a double thickness; a bottom wing extending outwardly from one side of the planar web; a bottom planar web portion extending between the bottom flange and the bottom wing; a top wing extending outwardly from one side of the planar web; a top planar web portion extending between the top flange and the top wing; and whereby the planar web, the bottom flange, the top flange, the bottom wing, the bottom planar web portion, the top wing and the top planar web portion are made from a unitary piece of steel.

A steel joist system for use in association with a concrete slab to form a composite steel joist system includes a plurality of steel joists and a deck attached to the plurality of steel joists. The deck may be attached with a plurality of screws and the screws may have a multi-shear connectors attached thereto which extends upwardly. The multi-shear connectors may have a bottom portion, a back portion, a sloped portion and two side portions wherein the bottom portion rests on the deck, the back portion extends upwardly from the bottom portion, the side portions extend inwardly from the back portion and the sloped portion is sloped inwardly from the back portion whereby the side portions and sloped portions are shaped to receive a reinforcing bar. The steel joist system may further include a plurality of reinforcing bars extending through the end connectors and extending through the multi-shear connectors. The steel reinforcing bars may form a perimeter around a predetermined floor area. Wire mesh may be placed on top of the reinforcing bars.

A multi-shear connector includes a bottom portion, a back portion, a sloped portion and two side portions wherein the bottom portion rests on the deck, the back portion extends upwardly from the bottom portion, the side portions extend inwardly from the back portion and the sloped portion is sloped inwardly from the back portion whereby the side portions and sloped portions are shaped to receive a reinforcing bar.

A composite steel joist assembly includes a plurality of steel joists, a dovetail deck, and a concrete slab. Each joist has a top portion with a generally planar top surface and a planar web generally orthogonal to the generally planar top surface;

each joist having a pair of end connectors, one attached at each end of the steel joist and extending outwardly therefrom. The dovetail deck is attached to the plurality of steel joists. The concrete slab is poured into and around the dovetail deck.

Further features will be described or will become apparent in the course of the following detailed description.

BRIEF DESCRIPTION OF THE DRAWINGS

The embodiments will now be described by way of example only, with reference to the accompanying drawings, in which.

DETAILED DESCRIPTION

Figure 1:
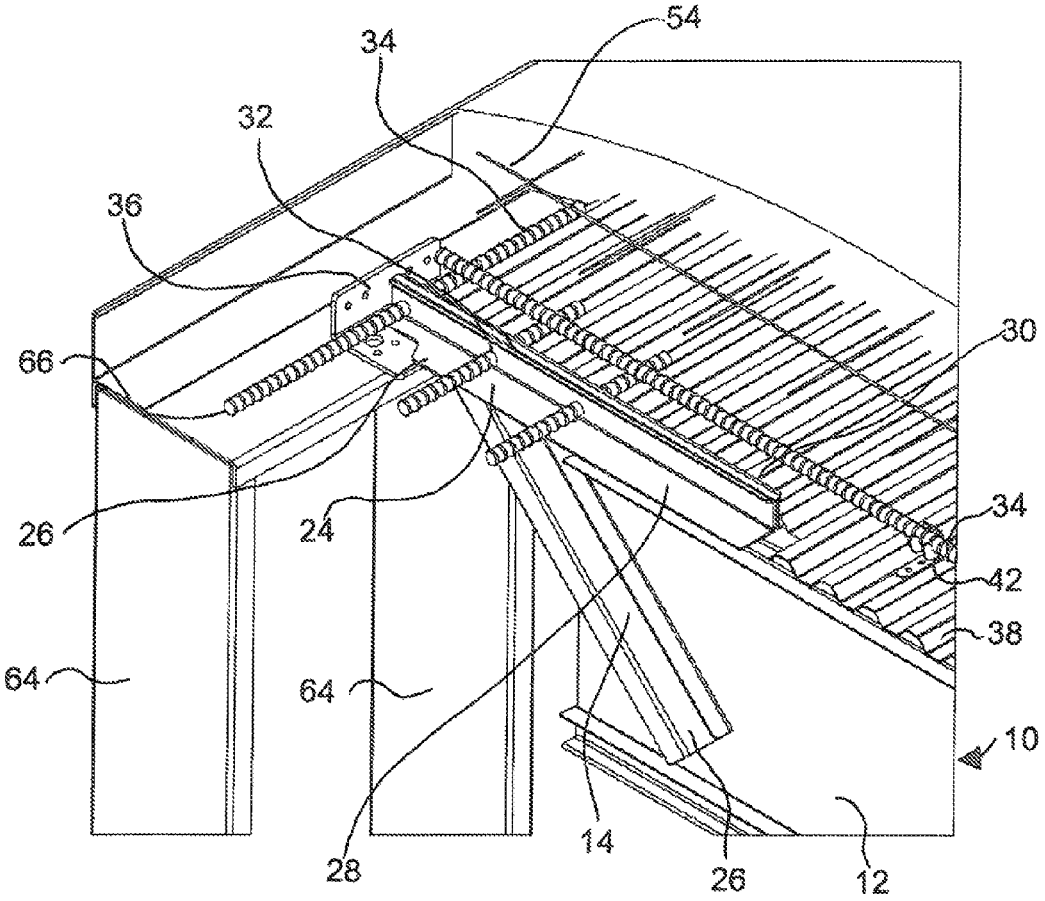
FIG. 1 is a perspective view of an embodiment of the steel joist assembly with a portion of the deck removed.

Referring to figure s 1 to 4, the steel joist assembly is shown generally at 10. Steel joist assembly 10 includes a steel joist 12 and a pair of end connectors 14. The end connectors 14 could work with any steel joist having a generally planar top surface and a planar web generally orthogonal to the bottom surface. The end connectors 14 may be used with any I beam shaped joists, alternatively they could be used with C-shaped joists. Accordingly, the end connectors are not applicable to open webbed steel joists. In an embodiment shown herein steel joists 12 are unitary steel joist as described in U.S. application Ser. No. 12/942,714, filed Nov. 9, 2010 and entitled Unitary Steel Joist and having the same inventors as shown herein. Steel joist 12 has a top flange 16, bottom flange 18 and a planar web 20 therebetween. The top flange 16 has a generally planar top surface.

The planar web 20 is a generally vertical. A generally horizontal bottom flange 18 extends outwardly on each side of the planar web 20. The bottom flange 18 has a double thickness. The generally horizontal top flange 16 extends outwardly on each side of the planar web 20. The top flange 16 has a double thickness. A bottom wing extends outwardly from one side of the planar web. A bottom planar web portion extends between the bottom flange and the bottom wing. A top wing extends outwardly from one side of the planar web. A top planar web portion extends between the top flange and the top wing; and the planar web, the bottom flange, the top flange, the bottom wing, the bottom planar web portion, the top wing and the top planar web portion are made from a unitary piece of steel.

End connector 14 includes a strut 24 and a diagonal member 26. The strut 24 has a generally planar bottom surface 28 which is attached to a portion of the generally planar top surface 22 of the steel joist 12. The diagonal member 26 is attached at one end thereof to the strut 24 and at the other end thereof to a portion of the planar web 20 of the steel joist 12.

In an embodiment shown herein the strut 26 is a pair of generally L-shaped members 28 arranged back to back and each having an upper lip 30 extending outwardly. Similarly the diagonal member 26 is a generally C- shaped member. The strut 26 have a plurality of holes 32 formed therein adapted to receive reinforcing bars 34.

The End connector 14 may further include a shoe 36 attached to the distal end of the strut 24. In an embodiment shown herein the shoe 36 is an L-shaped member.

The steel joist assembly including a steel deck attached to the generally planar top surface of the steel joist. In an embodiment the steel deck 38 is a corrugated steel deck having generally a trapezoidal shape.

Figure 5:
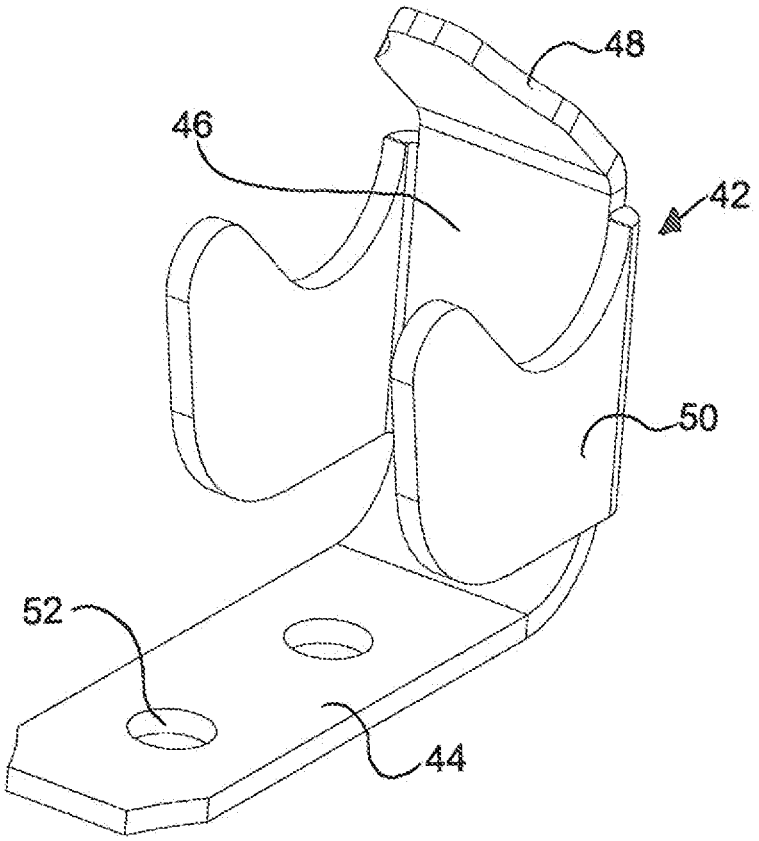
FIG. 5 is a perspective view of a multi-shear connector.
Figure 6:
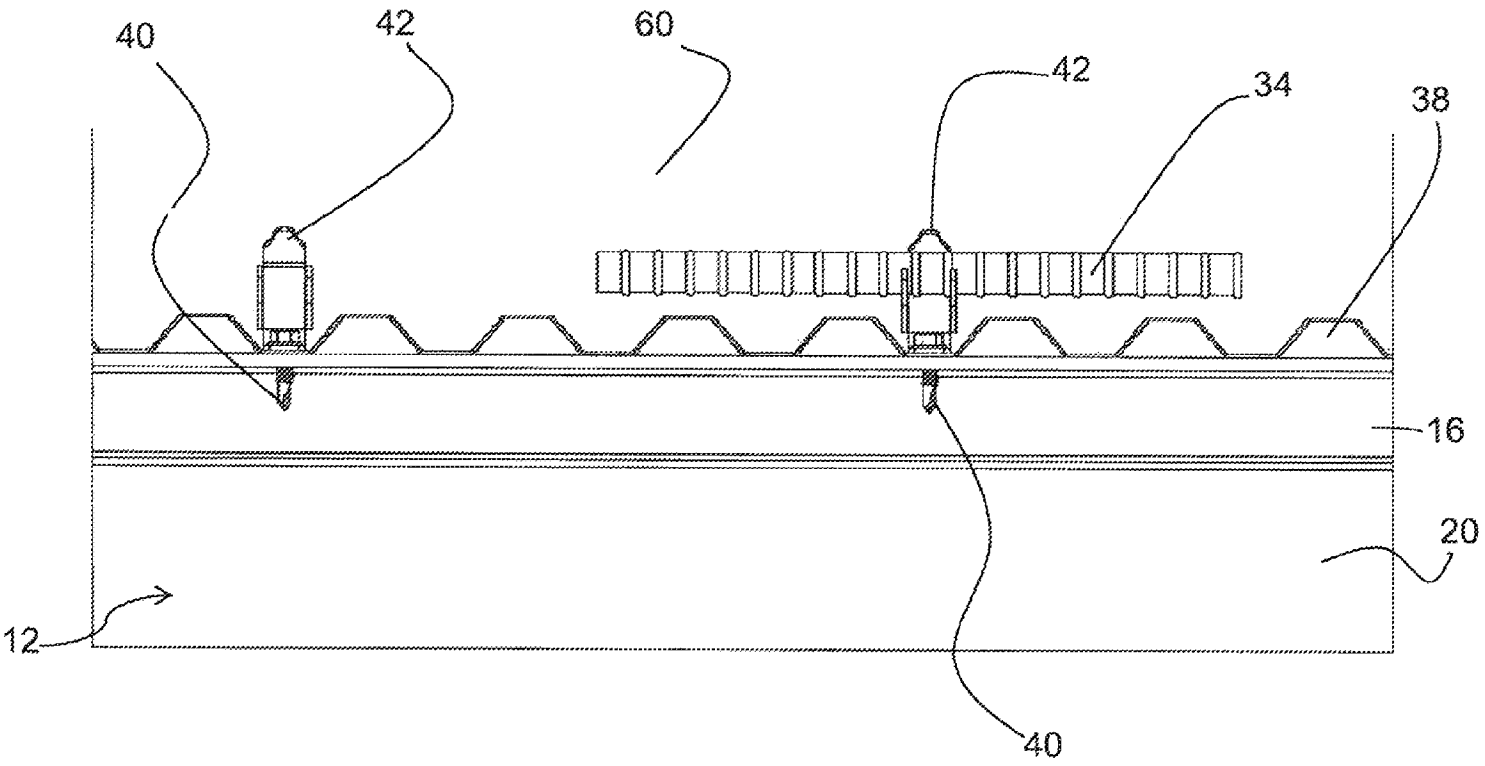
FIG. 6 is an enlarged cross sectional view of an embodiment of the steel joist assembly including a slab and showing multi-shear connector and a reinforcing bar located therein.
Figure 7:
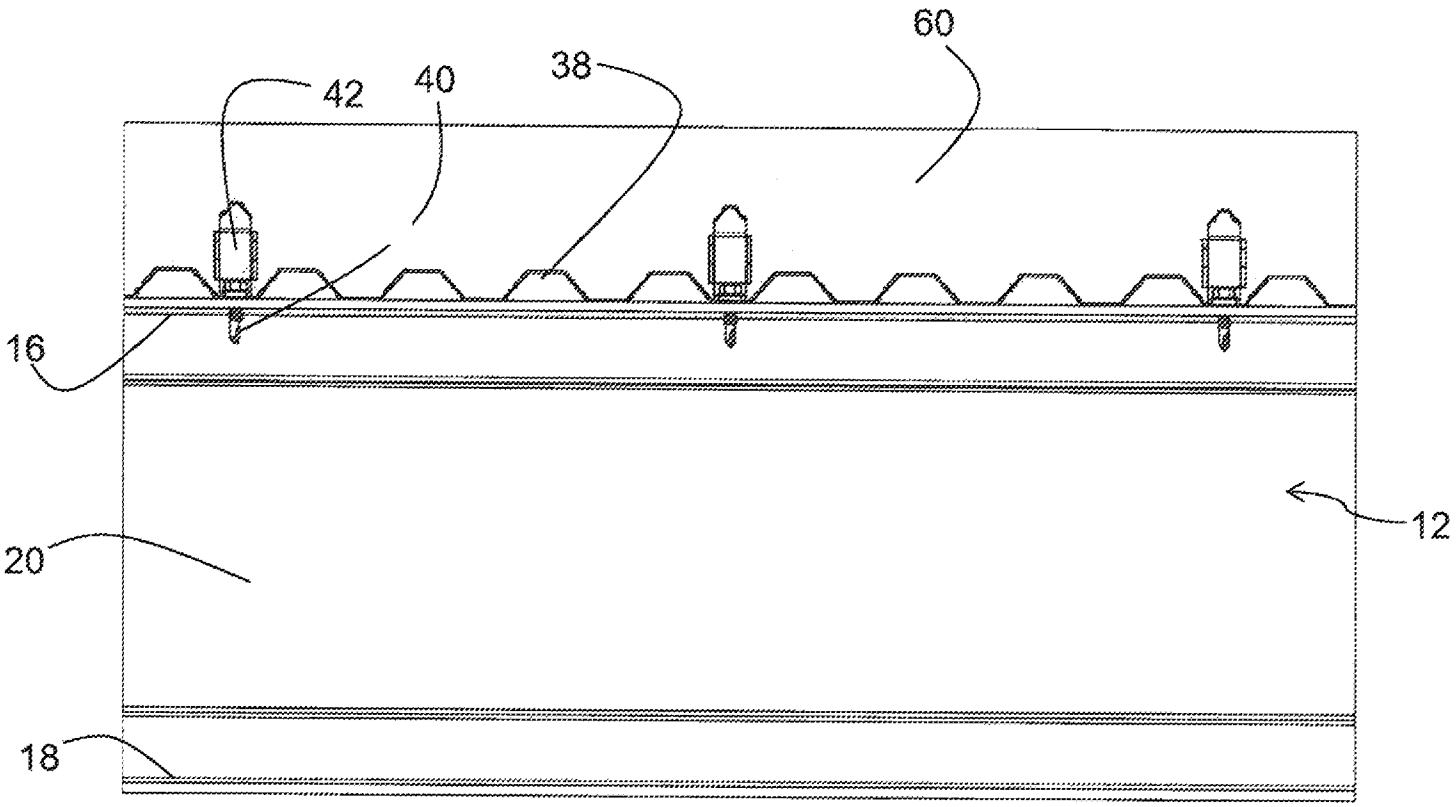
FIG. 7 is an enlarged cross sectional view of an embodiment of the steel joist assembly including a concrete slab similar to that shown in FIG. 6 but without the reinforcing bar.

The steel deck is held in place with a plurality of screws 40 or welds. In the embodiment shown therein multi-shear connectors 42 are connected to the screws 38 and extend upwardly over the deck 38. Referring to FIG. 5, the multi-shear connectors 42 have a bottom portion 44, a back portion 46, a sloped portion 48 and two side portions 50. The bottom portion 44 has a pair of holes 52 formed therein. Bottom portion 44 rests on the deck 38 and are held in place by screws 40 that fit through the holes 52. The back portion 46 extends upwardly from the bottom portion 44. The side portions 50 extend inwardly from the back portion 46 and the sloped portion 48 is sloped inwardly from the back portion 46. The side portions 50 and sloped portions 48 are shaped to receive a reinforcing bar 34.

Figure 9:
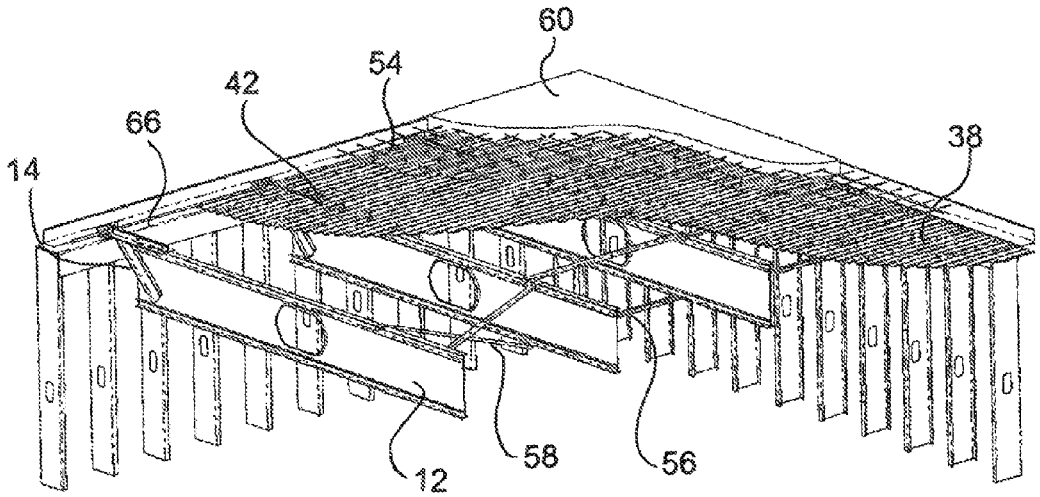
FIG. 9 is a perspective view of an embodiment of the steel joist system.
Figure 10:
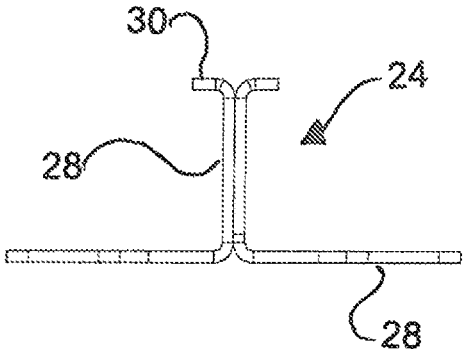
FIG. 10 is a cross sectional view of the strut used in the end connector.
Figure 11:
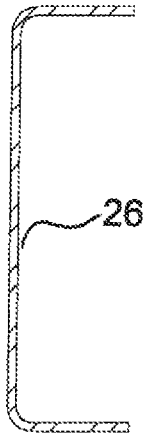
FIG. 11 is a cross sectional view of the diagonal member used in the end connector.

Referring to FIG. 9 there is shown a steel joist system that includes a plurality of steel joist assemblies and a steel deck 38. The deck is attached to the plurality of steel joist assemblies with a plurality of screws 40. The screws may have a plurality of multi-shear connectors 42 attached thereto. In an embodiment the steel joist system includes a plurality of reinforcing bars. The reinforcing bars 34 are positioned through the holes 32 in the struts 24. The reinforcing bars 34 may be spliced to create a continuous perimeter around a predetermined shape, the shape may be the entire floor area, a room or other predetermined shape. A plurality of reinforcing bars 34 extend through the multi-shear connectors 42. Wire mesh 54 is placed on top of the reinforcing bars. Bridging members 56 and cross bracing members 58 may also be used between adjacent steel joists 12. Concrete is then poured onto the deck to create a composite steel joist system having a concrete slab 60.

Figure 8:
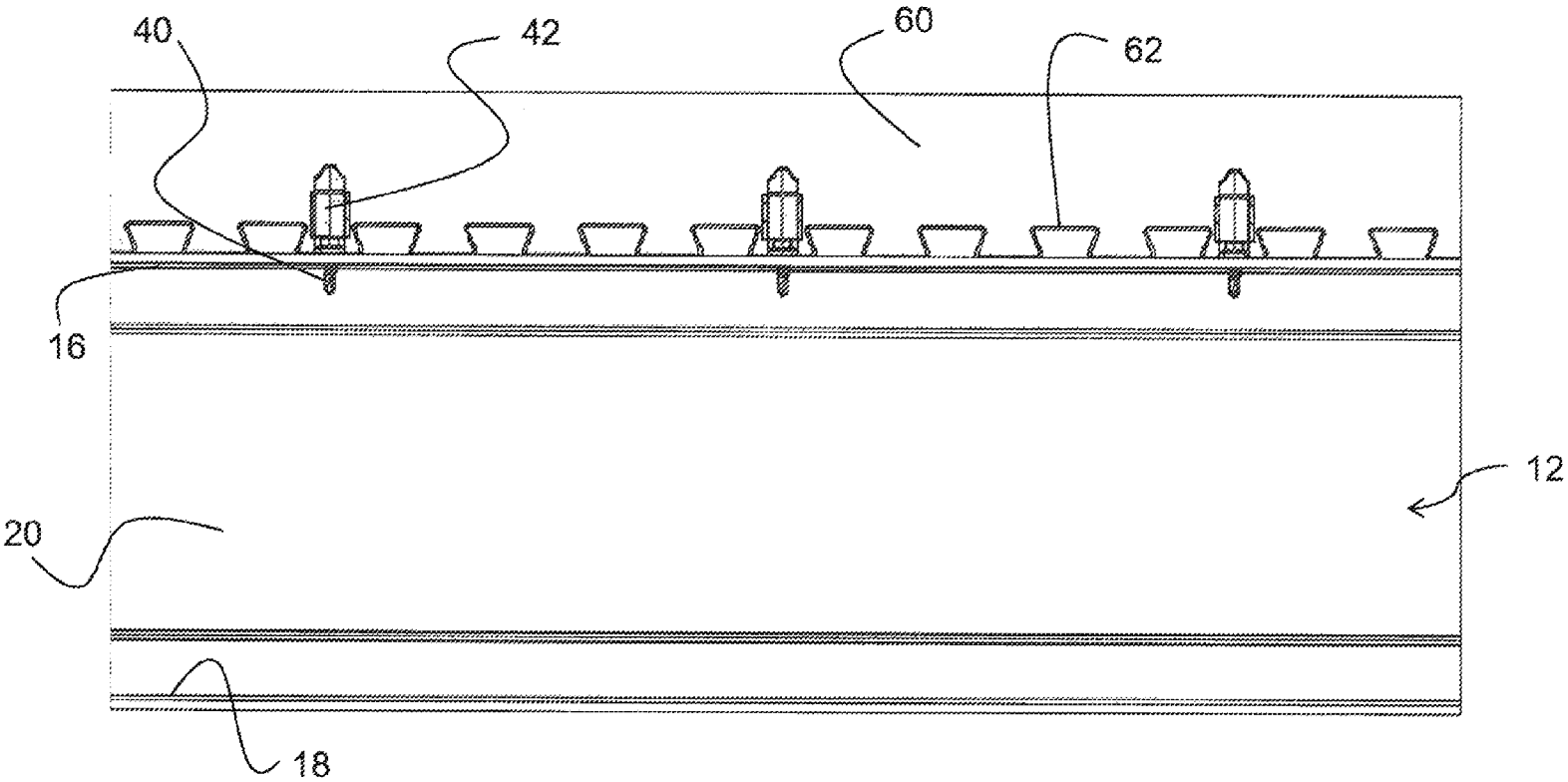
FIG. 8 is an enlarged cross sectional view similar to that shown in FIG. 7 but showing an alternate deck having a dovetail cross section.

An alternate deck 62 is shown in FIG. 8. Deck 62 has a dovetail pattern. Deck 62 increases the resistance to horizontal shear between the supporting steel joist 12 and the concrete slab. The combination of the multi-shear connectors 42, shoe 36 and the deck 62 creates a composite joist with three shear resisting elements; this provides the improved floor strength in a relatively simple manner. The dovetail deck 62 can also be used to provide composite action between the joist and the concrete slab without the need of multi-shear connectors. The concrete slab is poured into and around the dovetail deck 62.

In one embodiment the unitary steel joists 12 are cambered for dead load deflection.

Figure 2:
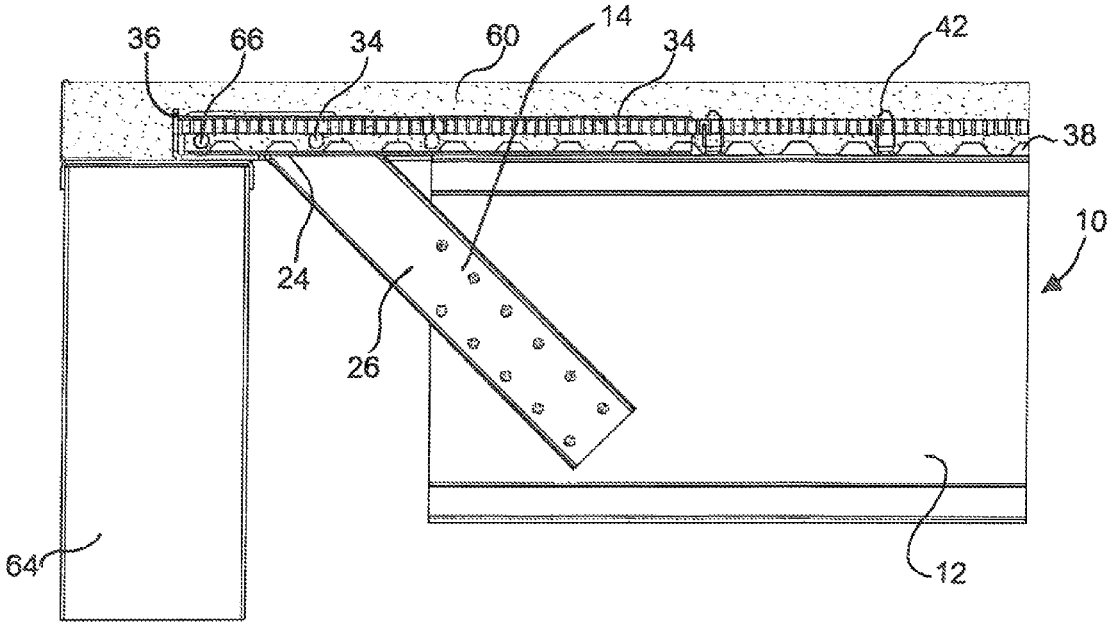
FIG. 2 is a cross sectional view of an embodiment of the steel joist assembly including multi-shear connectors and reinforcing bars.
Figure 3:
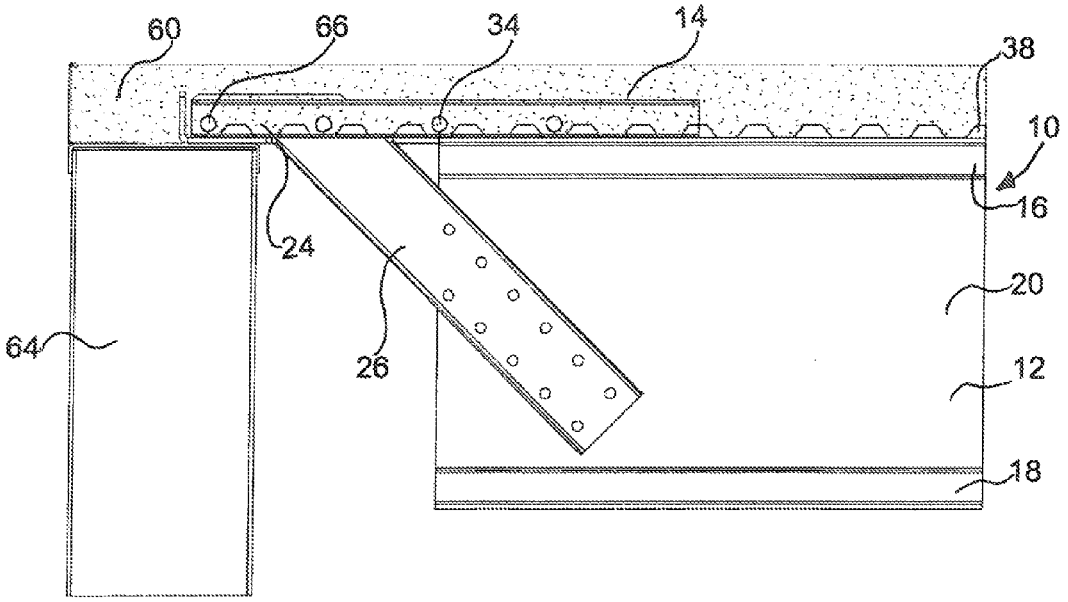
FIG. 3 is a cross sectional view of an alternate embodiment of the steel joist assembly.
Figure 4:
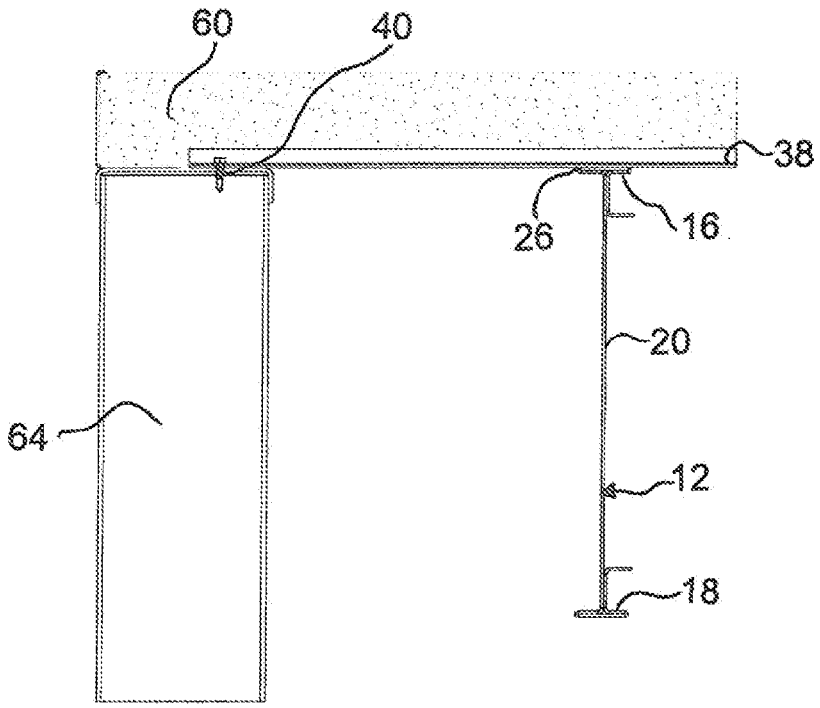
FIG. 4 is a cross sectional view of the steel joist assembly similar to the views shown in FIGS. 2 and 3 but taken perpendicular to those views.

There are a number of advantages that are realized by the composite steel joist system shown herein. For example end connectors 14 that sit flush with the supporting member 64, as shown in FIGS. 2 and 3, so that the support connection is within the confines of the concrete slab thickness. The composite system described herein shows a method to transfer diaphragm loads from the concrete floor slab 60 to the perimeter beam in a concentric manner without the need for overpour, this may be referred to as a passive concentric tie-beam.

The multi-shear connectors 42 can function alone without reinforcing bar and provide shear bond capacity between the steel joist 12 and the concrete slab 60. Alternatively the multi-shear connectors may be used in conjunction with reinforcing bar 34 which is "a high chair" for reinforcing mesh 54 and allows for the installation of a reinforcing bar 34 to reinforce the concrete slab 60. In addition the strut provides for a coordinated method of locating a short reinforcing bar at the joist end support to increase shear capacity at the joists most vulnerable location and provides a method to transfer loads from the joist end to the perimeter beam.

Generally speaking, the systems described herein are directed to a steel joist assembly and a steel joist system. Various embodiments and aspects of the disclosure will be described with reference to details discussed below. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

As used herein, the term "exemplary" means "serving as an example, instance, or illustration," and should not be construed as preferred or advantageous over other configurations disclosed herein.

As used herein, the terms "about" and "approximately" are meant to cover variations that may exist in the upper and lower limits of the ranges of values, such as variations in properties, parameters, and dimensions. In one non-limiting example, the terms "about" and "approximately" mean plus or minus 10 percent or less.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

What is claimed is:

1. A steel joist assembly for use in association with a concrete slab to form a composite steel joist, and for use in association with a support with a generally planar top surface, comprising:

a steel joist having a top portion with a generally planar top surface and a planar web generally orthogonal to the generally planar top surface wherein the generally planar top surface of the steel joist is coplanar with the generally planar top surface of the support;

a pair of end connectors, each attached at each end of the steel joist and extending outwardly therefrom, each end connector having a strut, a diagonal member and a shoe, the strut having a generally planar bottom surface which is attached to a portion of the generally planar top surface of the steel joist, the shoe being attached to the distal end of the strut and the diagonal member being attached at one end thereof to the strut and at the other end thereof to a portion of the planar web of the steel joist.

2. The steel joist assembly as claimed in claim 1 wherein the strut is a pair of generally L-shaped members arranged back to back and each having an upper lip extending outwardly.

3. The steel joist assembly as claimed in claim 2 wherein the diagonal member is a generally L-shaped member.

4. The steel joist assembly as claimed in claim 2 wherein the pair of generally L-shaped members each have a plurality of holes formed therein adapted to receive reinforcing bars.

5. The steel joist assembly as claimed in claim 1 further including a steel deck attached to the generally planar top surface of the steel joist.

6. The steel joist assembly as claimed in claim 5 wherein the deck is attached with a plurality of screws and the screws have a multi-shear connectors attached thereto which extend upwardly.

7. The steel joist assembly as claimed in claim 6 wherein the multi-shear connectors have a bottom portion, a back portion, a sloped portion and two side portions wherein the bottom portion rests on the deck, the back portion extends upwardly from the bottom portion, the side portions extend inwardly from the back portion and the sloped portion is sloped inwardly from the back portion whereby the side portions and the sloped portions are shaped to receive a reinforcing bar.

8. The steel joist assembly as claimed in claim 1 wherein the steel joist is a unitary steel joist.

9. The steel joist assembly as claimed in claim 1 wherein the steel joist further has a generally horizontal bottom flange extending outwardly on each side of the planar web, the bottom flange having a double thickness;

a generally horizontal top flange extending outwardly on each side of the planar web, the top flange having a double thickness;

a bottom wing extending outwardly from one side of the planar web;

a bottom planar web portion extending between the bottom flange and the bottom wing;

a top wing extending outwardly from one side of the planar web;

a top planar web portion extending between the top flange and the top wing; and whereby the planar web, the bottom flange, the top flange, the bottom wing, the bottom planar web portion, the top wing and the top planar web portion are made from a unitary piece of steel.

10. A steel joist system for use in association with a concrete slab to form a composite steel joist system comprising:

a plurality of steel joist assemblies each comprising a steel joists each having a top portion with a generally planar top surface and a planar web generally orthogonal to the generally planar top surface;

a pair of end connectors, each attached at each end of the steel joist each having a strut and a diagonal member, the strut having a generally planar bottom surface which is attached to a portion of the generally planar top surface of the steel joist and the diagonal member being attached at one end thereof to the strut and at the other end thereof to a portion of the planar web of the steel joist and at least one of the end connectors has at least one hole in the strut configured to receive a reinforcing bar; and at least one reinforcing bar received the at least one hole such that it is parallel to the plane defined by the top portion of the steel joist; and a steel deck attached to the plurality of steel joist assemblies.

11. The steel joist system as claimed in claim 10 wherein the deck is attached with a plurality of screws and the screws have a multi-shear connectors attached thereto which extend upwardly.

12. The steel joist system as claimed in claim 11 wherein the multi-shear connectors have a bottom portion, a back portion, a sloped portion and two side portions wherein the bottom portion rests on the deck, the back portion extends upwardly from the bottom portion, the side portions extend inwardly from the back portion and the sloped portion is sloped inwardly from the back portion whereby the side portions and the sloped portions are shaped to receive a reinforcing bar.

13. The steel joist system as claimed in claim 11 wherein the end connectors have a plurality of holes formed therein to receive a plurality of reinforcing bars.

14. The steel joist system as claimed in claim 13 further including a plurality of reinforcing bars extending through the end connectors and extending through the multi-shear connectors.

15. The steel joist system as claimed in claim 14 wherein at least some of the reinforcing bars form a perimeter around a predetermined floor area.

16. The steel joist system as claimed in claim 14 further including wire mesh placed on top of the reinforcing bars.

17. The steel joist system as claimed in claim 10 wherein the end connectors have a plurality of holes formed therein configured to receive a plurality of reinforcing bars further including a plurality of reinforcing bars positioned therein.

18. A composite steel joist assembly comprising:

a plurality of steel joists, each joist having a top portion with a generally planar top surface and a planar web generally orthogonal to the generally planar top surface;

each joist having a pair of end connectors, each attached at each end of the steel joist and extending outwardly therefrom;

a dovetail deck attached to the plurality of steel joists, wherein the cross section of extruded shapes expand outwardly from the plurality of steel joists such that the cross-section generally forms dovetail shapes; and a concrete slab poured into and around the dovetail deck, wherein each end connector has a strut and a diagonal member, the strut has a generally planar bottom surface which is attached to a portion of the generally planar top surface of the steel joist and the diagonal member is attached at one end thereof to the strut and at the other end thereof to a portion of the planar web of the steel joist.

19. The composite steel joist assembly as claimed in claim 18, wherein the dovetail deck is attached with a plurality of screws and the screws have a multi-shear connectors attached thereto which extend upwardly.

20. The composite steel joist assembly as claimed in claim 19 wherein the multi-shear connectors have a bottom portion, a back portion, a sloped portion and two side portions wherein the bottom portion rests on the deck, the back portion extends upwardly from the bottom portion, the side portions extend inwardly from the back portion and the sloped portion is sloped inwardly from the back portion whereby the side portions and the sloped portions are shaped to receive a reinforcing bar.

21. The composite steel joist assembly as claimed in claim 18 wherein the dovetail deck is attached with a plurality of screws and the screws have a multi-shear connectors attached thereto which extend upwardly.

22. The composite steel joist assembly as claimed in claim 21 wherein the multi-shear connectors have a bottom portion, a back portion, a sloped portion and two side portions wherein the bottom portion rests on the deck, the back portion extends upwardly from the bottom portion, the side portions extend inwardly from the back portion and the sloped portion is sloped inwardly from the back portion whereby the side portions and the sloped portions are shaped to receive a reinforcing bar.

* * * * *